US005211768A

United States Patent [19]

Preisser et al.

[11] Patent Number: 5,211,768

[45] Date of Patent: May 18, 1993

[54] METHOD OF NITRIDING WORK PIECES OF STEEL UNDER PRESSURE

[75] Inventors: Friedrich Preisser, Buedingen; Rudolf Seif, Bruchkoebel, both of Fed. Rep. of Germany

[73] Assignee: Degussa Aktiengesellschaft, Frankfurt am Main, Fed. Rep. of Germany

[21] Appl. No.: 926,023

[22] Filed: Aug. 7, 1992

Related U.S. Application Data

[63] Continuation of Ser. No. 791,732, Nov. 14, 1991, abandoned.

[30] Foreign Application Priority Data

Nov. 15, 1990 [DE] Fed. Rep. of Germany ..... 4036381

[51] Int. Cl.[5] ..... C21D 1/06

[52] U.S. Cl. ..... 148/230; 148/212

[58] Field of Search ..... 148/230, 228, 212

[56] References Cited

U.S. PATENT DOCUMENTS 2,779,697 1/1957 Chennault ..... 148/230
4,417,927 11/1983 Fullman ..... 148/230
4,793,871 12/1988 Dawes et al. ..... 148/230

FOREIGN PATENT DOCUMENTS 0105835 4/1984 European Pat. Off. .

OTHER PUBLICATIONS

Kirk Othmer's Encyclopedia of Chemical Technology, vol. 15, Third Edition, pp. 313–323.

*Primary Examiner*—Deborah Yee
*Attorney, Agent, or Firm*—Beveridge, DeGrandi, Weilacher & Young

[57] ABSTRACT

Very low-pore, thick nitride cases may be obtained in a short time during a gas nitriding process in accordance with the invention. This process includes nitriding in a gaseous mixture containing about 5 to 95% by volume ammonia and about 95 to 5% by volume nitrogen. The nitriding process is most preferably carried out at essentially a constant pressure above about 0.2 MPa.

25 Claims, No Drawings

METHOD OF NITRIDING WORK PIECES OF STEEL UNDER PRESSURE

This application is a continuation of application Ser. No. 07/791,732, filed Nov. 14, 1991, which application is entirely incorporated herein by reference and is abandoned.

BACKGROUND OF THE INVENTION

The invention relates to a method for nitriding steel work pieces in a gaseous atmosphere containing atomic nitrogen at temperatures above 425° C. and pressures above 0.2 MPa.

Nitride cases are generated in accordance with the current state of the art on work pieces of steel alloys in a salt bath by means of gas nitriding or by means of plasma nitriding. These nitride cases improve the corrosion resistance, the wear resistance and the oscillating resistance of the steels. They include a so-called "white layer" (i.e. the nitrogen rich layer), which is a few micrometers thick, over a nitrogen diffusion layer, which is generally produced by means of the above-mentioned gas nitriding or plasma nitriding methods at process times on the order of 100 hours. The diffusion layer includes nitrogen dissolved in the iron matrix, and it is located beneath the compound layer, wherein the compound layer includes the nitride layer and the white layer (i.e., the compound layer is an $Fe_xN_x$ layer).

Gas nitriding has particularly received a great impetus in recent years. In conventional gas nitriding processes, the steel parts are heated in an atmosphere of nitrogen-releasing gases, preferably in an atmosphere of ammonia, in order to introduce nitrogen into the surface of the steel.

Nitrogen is produced during the dissociation of ammonia according to the following reaction $$NH_3 \rightarrow N + 3\,H$$

The unstable nitrogen and hydrogen products react rapidly to form hydrogen gas ($H_2$) and inert nitrogen ($N_2$).

However, only nitrogen in the form of N atoms can be absorbed into the steel; therefore, only ammonia dissociating at the surface of the steel can supply the nitrogen for the case. The absorbed nitrogen diffuses into the steel and reacts to form precipitates of the nitrides of iron and any alloying elements. This precipitation creates compressive stresses which result in the case hardness.

Other alloying metals, such as aluminum, chromium, molybdenum, vanadium, or tungsten in solid solution, may be included with the steel to be nitrided. In fact, many plain carbon steels are known to produce a brittle case when nitrided. Stainless steel may be successfully nitrided.

Since no quenching is required after nitriding, before the nitriding process, the steels should be completely heat-treated so as to include the necessary properties in the steel base material. For example, 0.25–0.5 wt % carbon containing steel is quenched and tempered to the required core hardness prior to nitriding. In some alloys, the case hardness is directly proportional to the hardness of the underlying core steel.

Various metal case hardening processes, including nitriding, are described in Kirk-Othmer's Encyclopedia of Chemical Technology, Third Edition, Vol. 15, pages 313–323, which description is entirely incorporated herein by reference.

U.S. Pat. No. 2,779,697 teaches a method for nitriding steels in gaseous ammonia under pressure, which patent is entirely incorporated herein by reference.

In the method described in this patent, a pressure vessel is filled with a predetermined amount of ammonia and heated to temperatures between 425° C. and 640° C. (800°–1200° F.). This heating causes an ammonia pressure of a few bars to build up within the pressure vessel. Nitride cases of 20 to 40 μm are obtained thereby within approximately 15 hours. The thickness of the nitride case is a function of the amount of ammonia, the pressure and the temperature. However, this method has not been able to gain general acceptance in practice.

SUMMARY OF THE INVENTION

The present invention relates to a method for the nitriding steel work pieces in a gaseous atmosphere containing atomic nitrogen above 425° C. and pressures above 0.2 MPa. In the method of this invention, pore-free white layers up to about 50 μm thick may be generated in a short time on non-alloyed and on alloyed steels, without special pretreatment.

In this application, the term "pore-free" is meant to refer to compound layers wherein the volume of the pores is less than or equal to 5% of the volume of the compound layer. Preferably, the volume of the pores is less than or equal to 2% of the volume of the compound layer. The term "compound layer" refers to the combination of the nitride layer and the white layer, i.e., the $Fe_xN_x$ layer.

DETAILED DESCRIPTION OF THE INVENTION

In accordance with this invention, a nitrogenous gaseous atmosphere is used which includes about 5 to 95% by volume ammonia and about 95 to 5% by volume molecular nitrogen ($N_2$). Advantageously, nitriding takes place under essentially a constant gas pressure. By "essentially constant gas pressure," it is preferred that the gas pressure is maintained in the range of ±10% of the absolute pressure value during the process. Preferably, the process is carried out under as constant a pressure as may be maintained in the commercially available apparatuses.

Ammonia ($NH_3$), which dissociates at rather high temperatures into hydrogen and nitrogen, is used as the gas which releases atomic nitrogen. The use of pure ammonia, without an admixture of molecular nitrogen (i.e. 100% ammonia by volume), results in distinctly poorer white layers.

Nitride cases up to about 50 μm are obtained in about 4 to 5 hours when using the gaseous atmosphere in accordance with this invention. The white layers made by this process are essentially pore-free. The ratio of the γphase to the e phase can be adjusted depending on the process parameters used. In the most preferred embodiment, about 100% of the γphase is produced. Austenitic steels and steels with a high chromium content can be nitrided without any chemical pretreatment.

This method is suitable for treating work pieces of any geometric shape and in any desired number. The number of parts which may be treated is determined solely by the available furnace size. An oven-type furnace for batch treatment of parts can be heated to temperatures up to 1200° C., which typically produces an absolute inner pressure of about 0.2 to 10 MPa.

The treatment parameters of temperature, time, absolute pressure and partial pressure of the nitrogen-releasing gas can be adjusted in such a manner that optimum treatment conditions result for each work material. Temperatures in the range of about 500° to 900° C. have proven to be favorable as the nitriding temperatures. Moreover, it is most preferable that the nitriding process be carried out during the entire nitriding time under essentially a constant pressure as discussed above. Large variations in the pressure impair the good properties and the reproducibility of the white layers. The treatment time is a function of the steel grade and of the desired case layer thickness.

The following examples are intended to illustrate the invention, and should not be considered as limiting the inventions.

EXAMPLES

Example 1

A steel with the composition C 45 is nitrided in a pressure-resistant oven-type furnace at about 700° C. with a gaseous mixture containing about 30% by volume ammonia and about 70% by volume nitrogen at about 2 MPa superpressure (i.e. excess pressure). After one hour, a white layer about 40 μm thick has been formed, which layer is essentially pore-free.

The initial steel composition C 45 has the following elemental composition:

| Element | Weight % |
|---|---|
| Carbon | 0.42–0.5% |
| Silicon | ≦0.4% |
| Manganese | 0.5–0.8% |

Example 2

A diffusion zone 100 μm thick may be produced in the case of high-speed steels, by using a gaseous atmosphere containing about 80% by volume ammonia and about 20% volume nitrogen, at a pressure of approximately 1 MPa for about 4 hours at about 580° C.

Examples of high speed steel compositions for use in accordance with this Example include steels with elemental compositions in the following ranges or amounts:

| Element | Weight % |
|---|---|
| Carbon | about 1% |
| Silicon | ≦ about 0.45% |
| Manganese | ≦ about 0.4% |
| Cobalt | ≦ about 5–10% |
| Chromium | about 3–5% |
| Tungsten | about 2–15% |
| Vanadium | about 2% |

This composition example is intended to be illustrative of high speed steels for use with the invention and not intended to limit the same.

Example 3

An almost pore-free white layer 50 μm thick may be produced on a steel with the composition 16MnCr5 by heating to about 550° C. in a gaseous atmosphere containing about 70% by volume ammonia and about 30% by volume nitrogen under a pressure of about 8 MPa for about 2 hours.

The starting steel composition 16MnCr5 has the following elemental composition:

| Element | Weight % |
|---|---|
| Carbon | 0.14–0.19% |
| Silicon | 0.15–0.4% |
| Manganese | 1–1.3% |
| Chromium | 0.8–1.1% |

While the invention has been described in conjunction with specific examples, various modifications may be made without departing from the invention, as defined in the appended claims.

The priority document, German Patent Application No. P 40 36 381.3, filed in Germany on Nov. 15, 1990 is relied on and entirely incorporated herein by reference.

We claim:

1. A method for nitriding steel work pieces, comprising:

nitriding said work pieces by subjecting the work pieces to a temperature above 425° C. and an essentially constant pressure above 0.2 MPa and for a sufficient period of time in a gaseous atmosphere which includes about 5 to 95% by volume ammonia and about 95 to 5% by volume molecular nitrogen, said pressure being sufficient to thereby provide the desired nitride case.

2. The method according to claim 1, wherein the nitride case so provided is up to 50 micrometers thick.

3. The method according to claim 1, wherein the work pieces are subjected to the gaseous atmosphere for 4–5 hours.

4. The method according to claim 1, wherein the nitride case is essentially free from pores.

5. The method according to claim 1, wherein a white layer which is essentially 100% in the γphase is formed.

6. The method according to claim 1, wherein the work piece is constructed of austenitic steel.

7. The method according to claim 1, wherein the work piece is constructed of a steel with a high chromium content.

8. The method according to claim 1, wherein the pressure is in the range of 0.2 to 10 MPa.

9. The method according to claim 1, wherein the temperature for nitriding is up to 1200° C.

10. The method according to claim 1, wherein the temperature for nitriding is in the range of 500° to 900° C.

11. The method according to claim 1, wherein the gaseous atmosphere includes about 30% by volume ammonia and about 70% by volume nitrogen.

12. The method according to claim 11, wherein the temperature for nitriding is about 700° C.

13. The method according to claim 12, wherein the pressure is 2 about MPa.

14. The method according to claim 13, wherein the nitriding step takes about 1 hour.

15. The method according to claim 14, wherein a white layer is produced with a thickness of about 40 micrometers.

16. The method according to claim 1, wherein the gaseous atmosphere includes about 80% by volume ammonia and about 20% by volume nitrogen.

17. The method according to claim 16, wherein the pressure is about 1 MPa.

18. The method according to claim 17, wherein the temperature for nitriding is about 580° C.

19. The method according to claim 18, wherein the nitriding step takes about 4 hours 20. The method according to claim 19, wherein a diffusion zone about 100 micrometers thick is produced.

21. The method according to claim 1, wherein the gaseous atmosphere is about 70% by volume ammonia and about 30% by volume nitrogen.

22. The method according to claim 21, wherein the temperature for nitriding is about 550° C.

23. The method according to claim 22, wherein the pressure is about 8 MPa.

24. The method according to claim 23, wherein the nitriding step takes about 2 hours.

25. The method according to claim 24, wherein a white layer which is 50 micrometers thick is produced.

* * * * *